US008069842B2

(12) United States Patent
Kannan

(10) Patent No.: US 8,069,842 B2
(45) Date of Patent: Dec. 6, 2011

(54) INJECTOR MOUNTING ASSEMBLY

(75) Inventor: Venkatesh Kannan, Novi, MI (US)

(73) Assignee: Robert Bosch GmbH, Stuttgart (DE)

( * ) Notice: Subject to any disclaimer, the term of this patent is extended or adjusted under 35 U.S.C. 154(b) by 329 days.

(21) Appl. No.: 12/496,742

(22) Filed: Jul. 2, 2009

(65) Prior Publication Data

US 2011/0000464 A1 Jan. 6, 2011

(51) Int. Cl.
*F02M 61/14* (2006.01)
*F02M 61/18* (2006.01)

(52) U.S. Cl. ..... 123/470

(58) Field of Classification Search ..... 123/470, 123/467–469, 456; 239/600; 277/647, 395, 277/530, 567, 594, 313
See application file for complete search history.

(56) References Cited

U.S. PATENT DOCUMENTS

| | | | | |
|---|---|---|---|---|
| 4,519,371 | A | 5/1985 | Nagase et al. | |
| 4,938,193 | A | 7/1990 | Raufeisen et al. | |
| 4,991,556 | A | 2/1991 | Mahnke et al. | |
| 5,247,918 | A | 9/1993 | Wakeman | |
| 5,680,845 | A | 10/1997 | Peng | |
| 5,697,345 | A | 12/1997 | Genter et al. | |
| 5,785,024 | A * | 7/1998 | Takei et al. | 123/470 |
| 6,276,338 | B1 | 8/2001 | Kato et al. | |
| 6,338,333 | B1 | 1/2002 | Brosseau et al. | |
| 6,427,667 | B1 | 8/2002 | Kato | |
| 6,439,203 | B1 | 8/2002 | Cooke | |
| 6,543,421 | B2 | 4/2003 | Lorraine et al. | |
| 6,578,554 | B2 | 6/2003 | Schroeer | |
| 6,640,784 | B1 | 11/2003 | Sims, Jr. | |
| 6,701,899 | B2 | 3/2004 | Liskow | |
| 6,817,341 | B2 | 11/2004 | Scheffel | |
| 6,845,758 | B2 | 1/2005 | Seymour, II et al. | |
| 6,866,026 | B2 | 3/2005 | Mickelson | |
| 6,899,087 | B2 | 5/2005 | Norgauer | |
| 7,195,003 | B2 | 3/2007 | Liskow | |
| 7,293,550 | B2 | 11/2007 | Beardmore | |
| 7,331,331 | B2 | 2/2008 | Hanawa et al. | |
| 7,334,571 | B1 | 2/2008 | Beardmore | |
| 7,377,264 | B2 | 5/2008 | Buehner | |
| 7,412,970 | B2 | 8/2008 | Apel et al. | |
| 7,444,992 | B2 | 11/2008 | Ricci | |
| 7,484,499 | B2 | 2/2009 | Beardmore | |
| 7,600,502 | B2 | 10/2009 | Welzmueller et al. | |
| 7,823,565 | B2 * | 11/2010 | Chern et al. | 123/470 |
| 2002/0152995 | A1 | 10/2002 | Kato | |
| 2002/0162538 | A1 * | 11/2002 | Krause et al. | 123/470 |
| 2007/0113828 | A1 | 5/2007 | Fonville et al. | |
| 2007/0163545 | A1 | 7/2007 | Beardmore et al. | |

(Continued)

FOREIGN PATENT DOCUMENTS

DE 102007011316 A1 * 9/2008

(Continued)

*Primary Examiner* — Mahmoud Gimie
(74) *Attorney, Agent, or Firm* — Michael Best & Friedrich LLP

(57) ABSTRACT

An injector mounting arrangement includes a tolerance ring assembly that provides damping or absorption capabilities in addition to alignment and centering functionality. The tolerance ring assembly is designed to absorb axial excitation energy from the injector by converting it into strain energy through the radial deformation of the tolerance ring. The strain energy is absorbed in the form of bending stress within the tolerance ring more effectively than by simply absorbing the axial forces in compression alone. As a result, vibration and noise is reduced and/or isolated.

13 Claims, 7 Drawing Sheets

U.S. PATENT DOCUMENTS

2007/0221176 A1 9/2007 Hardy
2008/0265520 A1* 10/2008 Kurth ..... 277/549
2008/0302336 A1 12/2008 Fuerst et al.
2008/0314366 A1 12/2008 Welzmueller et al.
2009/0050113 A1 2/2009 Liskow
2009/0071445 A1 3/2009 Mueller et al.
2010/0175668 A1* 7/2010 Chern et al. ..... 123/470

FOREIGN PATENT DOCUMENTS

EP 1262652 12/2002
EP 1764501 3/2007

* cited by examiner

INJECTOR MOUNTING ASSEMBLY

BACKGROUND

The present invention relates to fuel injection mounting arrangements, and more particularly to mounting arrangements configured to dampen vibration and noise caused by the injectors.

FIG. 1 illustrates a prior art injector mounting arrangement for a direct-injection engine in which a fuel injector 10 is mounted directly in a receiving aperture 12 of a cylinder head 14. A tolerance ring 16 is positioned in the aperture 12 to receive and align the injector 10 therein. A curved alignment surface 18 of the tolerance ring 16 helps align and center the injector 10 in the aperture 12.

The illustrated prior art tolerance ring 16 is not, on its own, designed to provide any damping capabilities between the injector 10 and the cylinder head 14, i.e., to dampen noise and vibration caused by the injection forces on the injector 10 that cause axial movement of the injector 10 relative to the cylinder head 14 during engine operation.

SUMMARY

The invention provides an improved injector mounting arrangement utilizing an improved tolerance ring assembly that provides damping or absorption capabilities in addition to the alignment and centering functionality. The improved tolerance ring assembly includes a tolerance ring that is different from the prior art tolerance ring described above, in that it is designed to absorb axial excitation energy from the injector by converting it into strain energy through the radial deformation of the tolerance ring. The strain energy can be absorbed in the form of bending stress within the tolerance ring more effectively than by simply absorbing the axial forces in compression alone. As a result, vibration and noise is reduced and/or isolated.

In one embodiment, the invention provides a tolerance ring assembly for aligning an injector in a cylinder head and absorbing axial forces generated by the injector. The tolerance ring assembly includes a tolerance ring having a lower surface configured to be positioned adjacent the cylinder head, an alignment surface configured to be coupled to the injector, an inner portion that defines an aperture configured to at least partially receive a tip of the injector, and a stepped outer circumference along a radially-outermost periphery of the tolerance ring. The stepped outer circumference defines a first outer surface with a first diameter, and a second outer surface with a second diameter smaller than the first diameter.

In another embodiment, the invention provides an injector mounting assembly for aligning an injector in a cylinder head and absorbing axial forces generated by the injector. The injector mounting assembly includes a fuel injector and a tolerance ring having a lower surface positioned adjacent the cylinder head, an alignment surface coupled to the injector, an inner portion that defines an aperture configured to at least partially receive a tip of the injector, and a stepped outer circumference along a radially-outermost periphery of the tolerance ring. The stepped outer circumference defines a first outer surface with a first diameter and a second outer surface with a second diameter smaller than the first diameter. The injector mounting assembly further includes a retainer ring positioned radially outwardly of the second outer surface and supported by a step surface defined between the first and second outer surfaces. The tolerance ring is radially resiliently deflectable to absorb an axial force applied by the injector, and the radial deflection of the tolerance ring is limited by the retainer ring.

In yet another embodiment, the invention provides an injector mounting assembly for mounting an injector to a cylinder head and absorbing axial forces generated by the injector. The injector mounting assembly includes a fuel injector and a tolerance ring having a lower surface positioned adjacent the cylinder head, an alignment surface coupled to the injector, and an inner portion that defines an aperture configured to at least partially receive a tip of the injector. The injector mounting assembly further includes a disk spring positioned between the lower surface and the cylinder head.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
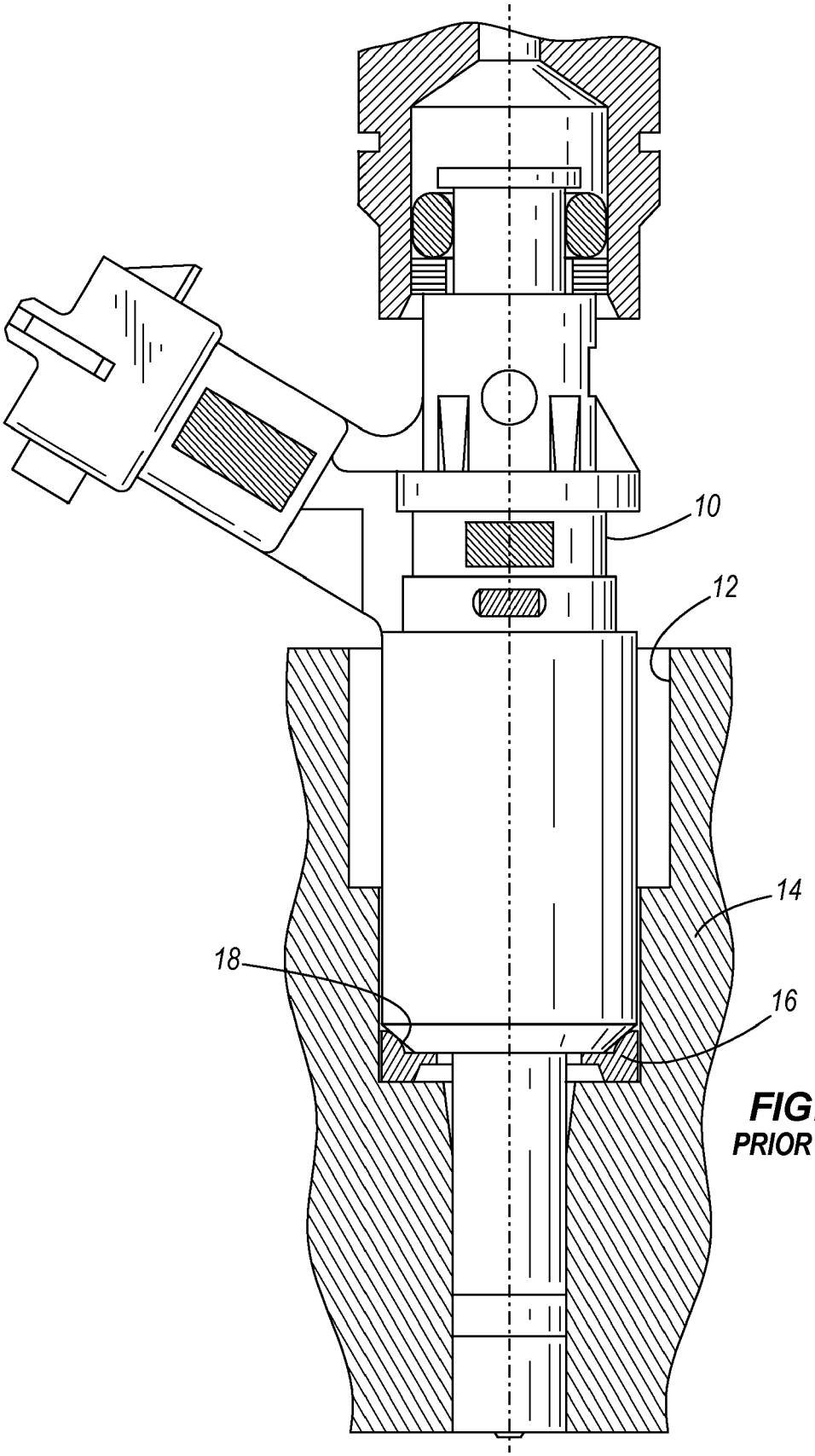
FIG. 1 PRIOR ART
FIG. 1 is a partial section view of a prior art injector mounting arrangement.
Figure 2:
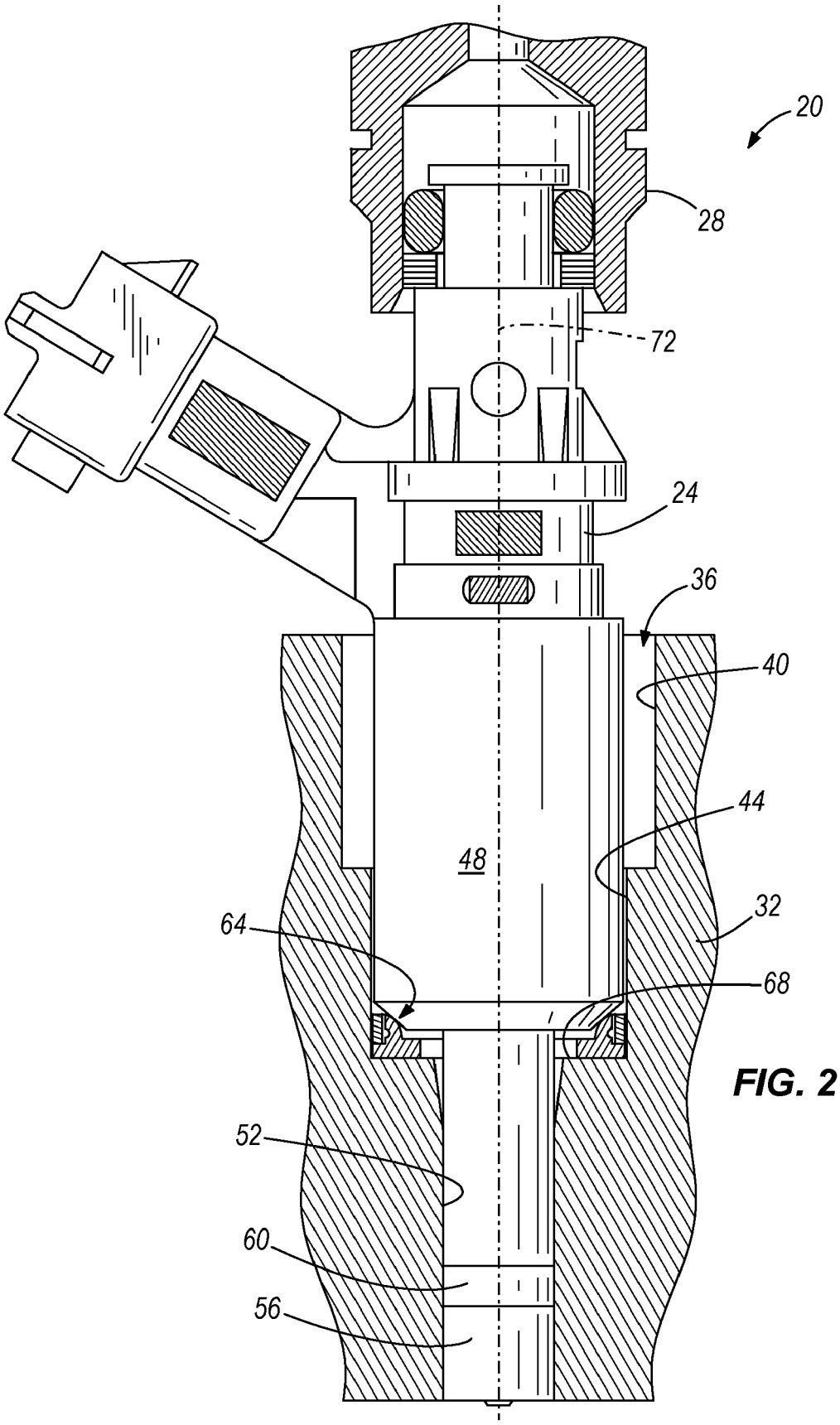
FIG. 2 is a partial section view of an injector mounting arrangement embodying the present invention.

FIG. 2 illustrates an injector mounting arrangement 20 of the present invention. A fuel injector 24 is coupled between a fuel rail 28 and a cylinder head 32 in a direct-injection engine arrangement. The cylinder head 32 includes a receiving aperture 36 sized and configured to receive the injector 24 therein. The illustrated aperture 36 includes a first bore portion 40, a second bore portion 44 sized and configured to be slightly larger than an outer diameter of a main body portion 48 of the injector 24, and a third bore portion 52 sized and configured to receive a tip 56 of the injector 24. A seal 60 on the tip 56 of the injector 24 engages an inner surface of the third bore portion 52.

A tolerance ring assembly 64 is positioned at the distal end of the second bore portion 44 on a step surface 68 between the second and third bore portions 44, 52. The tolerance ring assembly 64 provides damping and absorption capabilities in addition to an alignment and centering functionality. The tolerance ring assembly 64 helps dampen and absorb the forces created by axial movement of the injector 24, i.e., movement in a direction parallel to a longitudinal axis 72 (see FIG. 2) of the injector 24, during operation of the engine, as will be described in detail below. As a result, vibration and noise is reduced and/or isolated.

Figure 3:
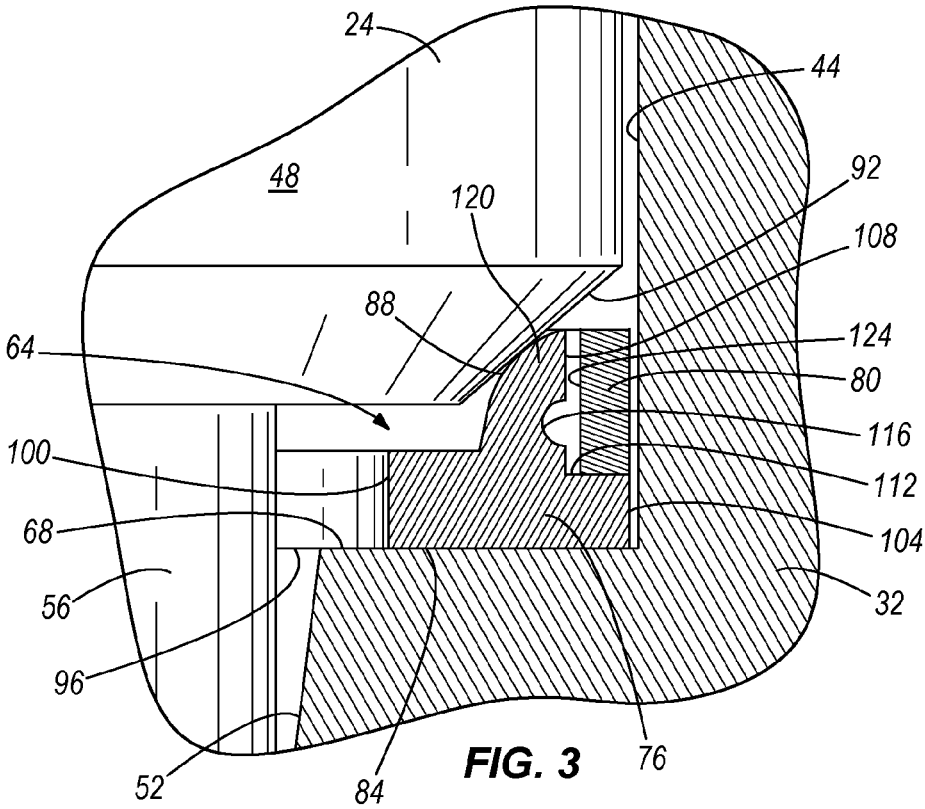
FIG. 3 is an enlarged partial section view illustrating the injector mounting arrangement of FIG. 2 with the tolerance ring assembly shown in a first, un-deflected position.
Figure 4:
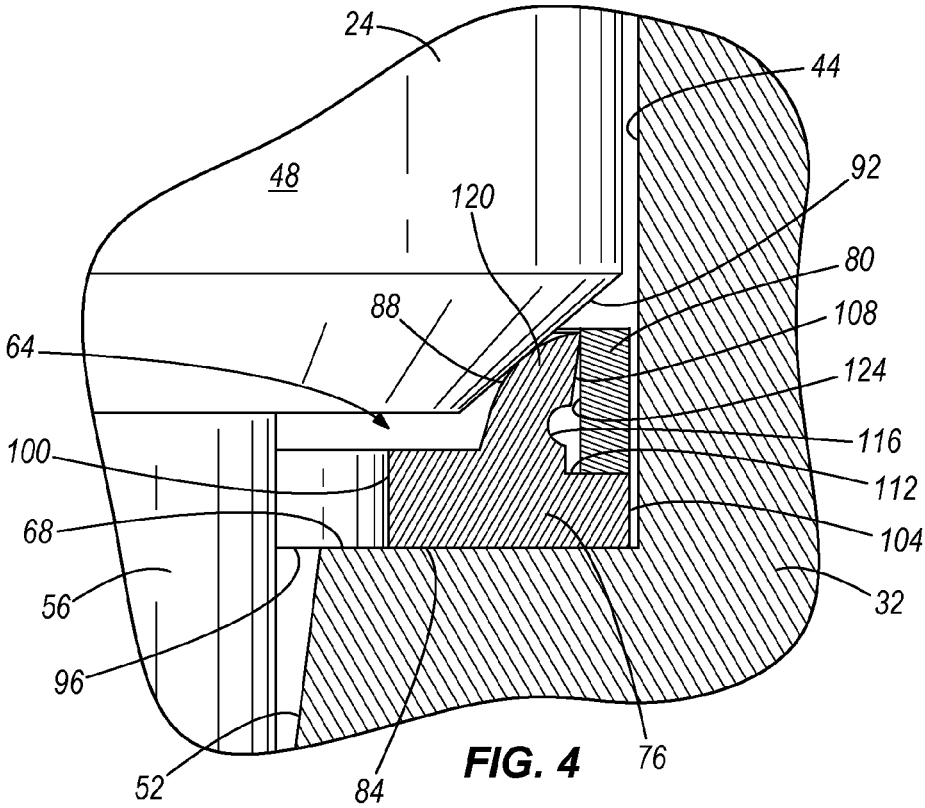
FIG. 4 is an enlarged partial section view illustrating the injector mounting arrangement of FIG. 2 with the tolerance ring assembly shown in a second, radially-deflected position.
Figure 5:
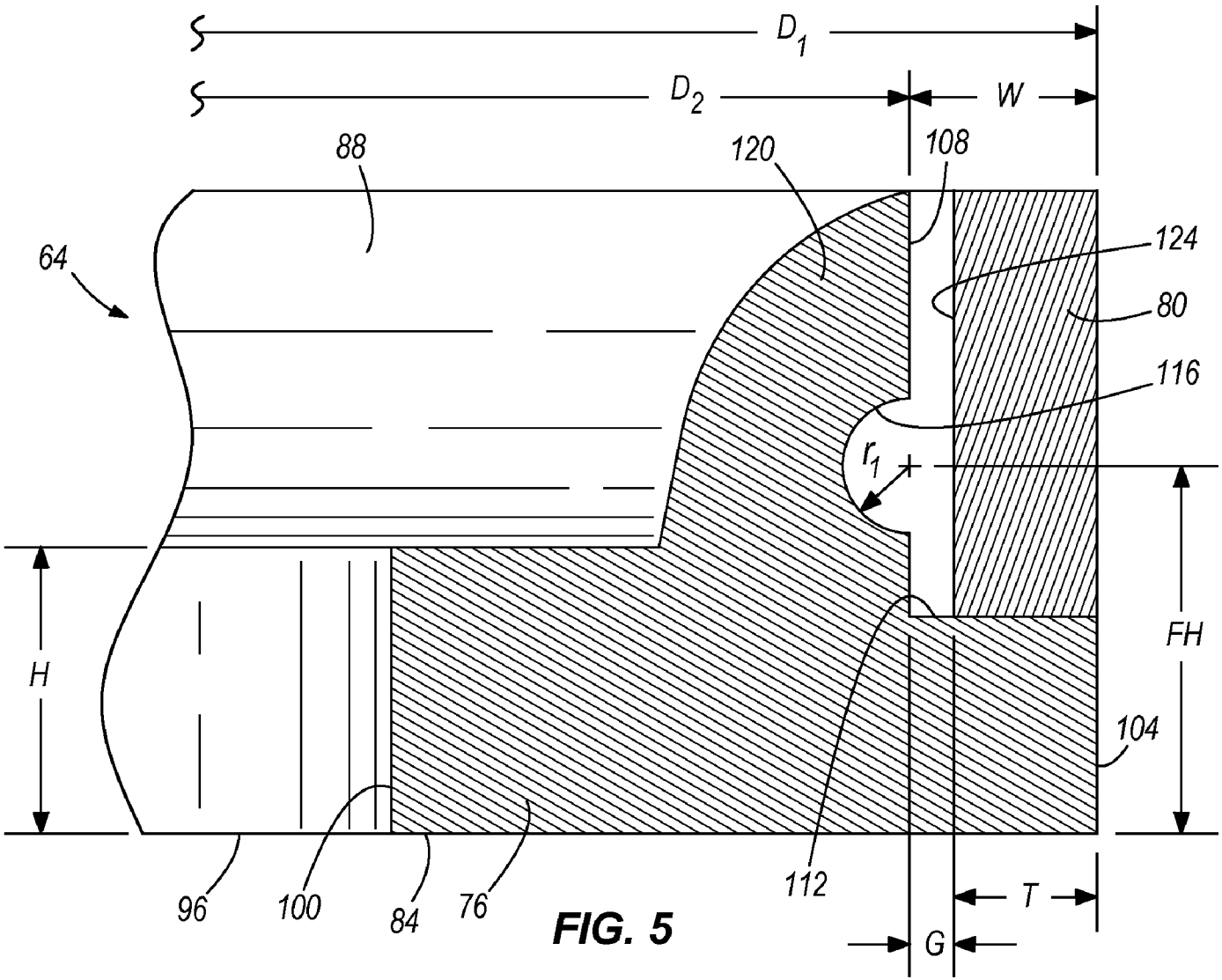
FIG. 5 is an enlarged partial section view of the tolerance ring assembly of FIG. 2.

Referring next to FIGS. 3-5, the tolerance ring assembly 64 includes a tolerance ring 76 and a retainer ring 80 coupled with the tolerance ring 76. The tolerance ring 76 includes a lower surface 84 positioned adjacent the cylinder head 32, and more specifically in the illustrated embodiment, the entire lower surface 84 abuts the step surface 68. In other embodiments, other features, such as seals, damping members, and the like may be positioned between the lower surface 84 and the step surface 68, however, the lower surface 84 is still considered to be positioned adjacent the cylinder head 32. The tolerance ring 76 further includes an alignment surface 88 positioned adjacent the injector 24. In the illustrated embodiment, the alignment surface 88 is arcuate or curved to align and center the injector 24 as it is inserted into the aperture 36. A tapered portion 92 of the body 48 directly engages the alignment surface 88 so as to center and align the injector 24. In other embodiments, the configuration of the alignment surface 88 and the tapered portion 92 can be varied as desired. Furthermore, other embodiments may include an additional feature or part between the alignment surface 88 and the tapered portion 92, however, the alignment surface 88 is still considered to be positioned adjacent the injector 24.

The tolerance ring 76 further includes an inner portion 96 that defines an aperture 100 sized and configured to at least partially receive the tip 56 of the injector 24. As the injector 24 is inserted into the receiving aperture 36 in the cylinder head 32, the tip 56 passes through the aperture 100 in the inner portion 96 and extends into the third bore portion 52. The illustrated inner portion 96 has a substantially constant height H (see FIG. 5)

The tolerance ring 76 also includes a stepped outer circumference along its radially-outermost periphery. The stepped outer circumference is defined by a first radially outer surface 104, a second radially outer surface 108, and a step surface 112 that intersects and is between both the first and second outer surfaces 104, 108. In the illustrated embodiment, the first outer surface 104 intersects each of the lower surface 84 and the step surface 112. The second outer surface 108 intersects each of the step surface 112 and the alignment surface 88. As shown in FIG. 5, the first outer surface 104 defines a first diameter $D_1$, which in the illustrated embodiment, is the largest diameter defined by the tolerance ring 76. The second outer surface 108 defines a second diameter $D_2$ that is smaller than the first diameter $D_1$. The difference between the diameters $D_1$ and $D_2$ defines a step width W of the step surface 112.

The illustrated tolerance ring 76 includes a fillet 116 formed at least partially in the second outer surface 108. The fillet 116 is provided as a feature for facilitating the resilient radial deflection of an upper portion 120 of the tolerance ring 76, i.e., the area bounded generally by the alignment surface 88 and the second outer surface 108. As shown in FIG. 5, the fillet 116 is formed at a fillet height FH from the lower surface 84, and has a radius $r_1$. In the illustrated embodiments, the fillet radius $r_1$ is about 0.5 mm to about 1 mm. As will be described further below, the placement of the fillet 116, the size of the fillet 116, and even the presence of the fillet 116 at all, are variable to achieve the desired stiffness of the upper portion 120 of the tolerance ring 76.

The stepped outer circumference of the tolerance ring 76 is sized and configured to support the retainer ring 80. More specifically, and as best shown in FIG. 5, the retainer ring 80 rests on the step surface 112 radially outwardly of the second surface 108, and in the illustrated embodiment, has an outer diameter substantially the same as the first diameter D1 of the tolerance ring 76. The thickness T of the retainer ring 80 is less than the step width W such that the inner diameter of the retainer ring 80 is larger than the second diameter D2 of the second outer surface 108 to define a clearance in the form of a gap G between the second outer surface 108 and an inner surface 124 of the retainer ring 80.

The tolerance ring assembly 64 is designed to absorb axial excitation or impact energy (in the direction parallel to the longitudinal axis 72—down in FIG. 2) from the injector 24 by converting it into strain energy through the radial deformation (in the direction normal to the longitudinal axis 72) of the tolerance ring 76. The strain energy is absorbed in the form of bending stress in the tolerance ring 76 and, in extreme instances, in the form of tensile stress within the retainer ring 80, more effectively than by simply absorbing the axial forces in compression alone. As a result, vibration and noise is reduced and/or isolated.

Referring first to FIG. 3, the tolerance ring assembly 64 is shown in its first, un-deflected position or state. The injector 24 rests on the alignment surface 88, but the axial force exerted on the tolerance ring 76 (in the downward direction in FIG. 3) by the injector 24 is not of a magnitude sufficient to cause any radial deformation of the tolerance ring 76. Referring now to FIG. 4, the injector exerts a greater axial force on the tolerance ring 76 during engine operation such that the upper portion 120 resiliently deflects in a radially outwardly direction. The axial force is large enough to cause the second outer surface 108 to deflect outwardly far enough to engage the inner surface 124 of the retainer ring 80. The position illustrated in FIG. 4 represents the maximum radial deflection of the tolerance ring 76, which is limited by the presence of the retainer ring 80. The tolerance ring 76 is able to deflect to any position between those represented in FIGS. 3 and 4, depending upon the magnitude of the axial force generated by the injector 24 on the tolerance ring 76 (e.g., deflects proportionally to the magnitude of the axial force). The presence of the retainer ring 80 limits the radial deflection of the second outer surface 108, thereby preventing the plastic deformation or breakage of the tolerance ring 76. However, is some embodiments, the retainer ring 80 may be eliminated.

Figure 6:
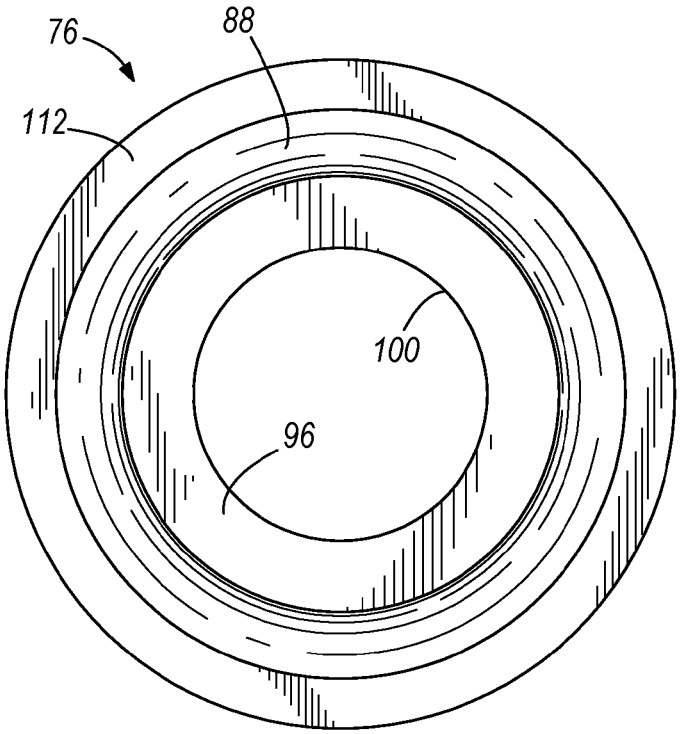
FIG. 6 is a top view of the tolerance ring of FIG. 2.
Figure 7:
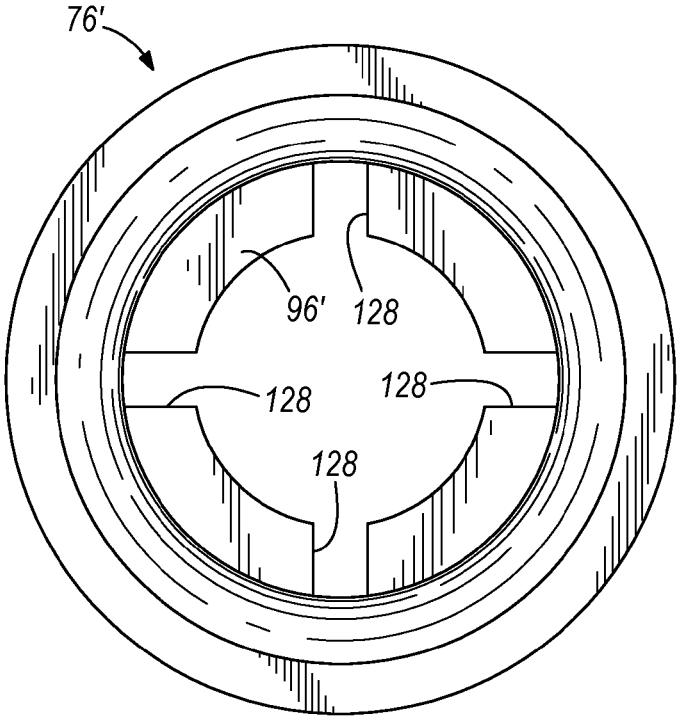
FIG. 7 is a top view of an alternative tolerance ring embodying the invention.

The tolerance ring 76 and the retainer ring 80 can be sized and configured to accommodate the specific axial injector forces for a given application. For example, the height H of the inner portion 96 can be modified as desired to change the overall stiffness of the tolerance ring 76. Additionally, while FIG. 6 illustrates that the inner portion 96 is consistent all around, FIG. 7 illustrates an alternative tolerance ring 76' in which the inner portion 96' includes notches or slots 128 to reduce the overall stiffness of the tolerance ring 76'. The number and position of the slots 128 can vary. Additionally, while FIG. 7 shows the slots 128 extending all the way through the inner portion 96', the slots 128 could be less than the full height H of the inner portion 96'.

Figure 8:
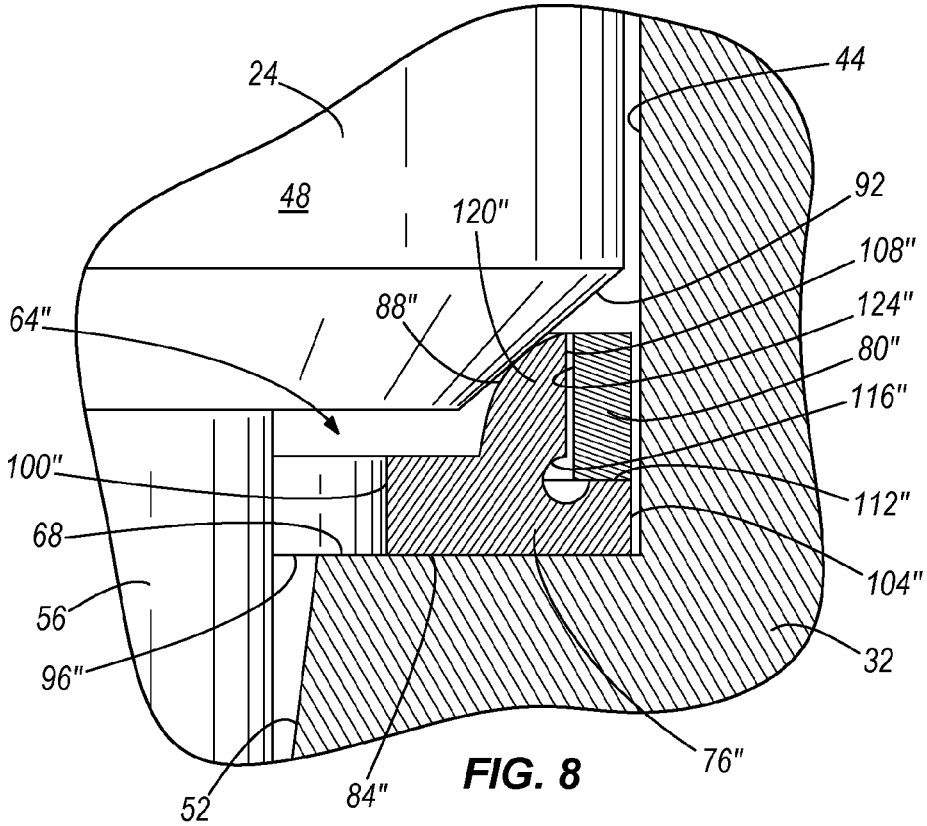
FIG. 8 is a view similar to FIG. 3 showing yet another alternative tolerance ring in a first, un-deflected position.
Figure 9:
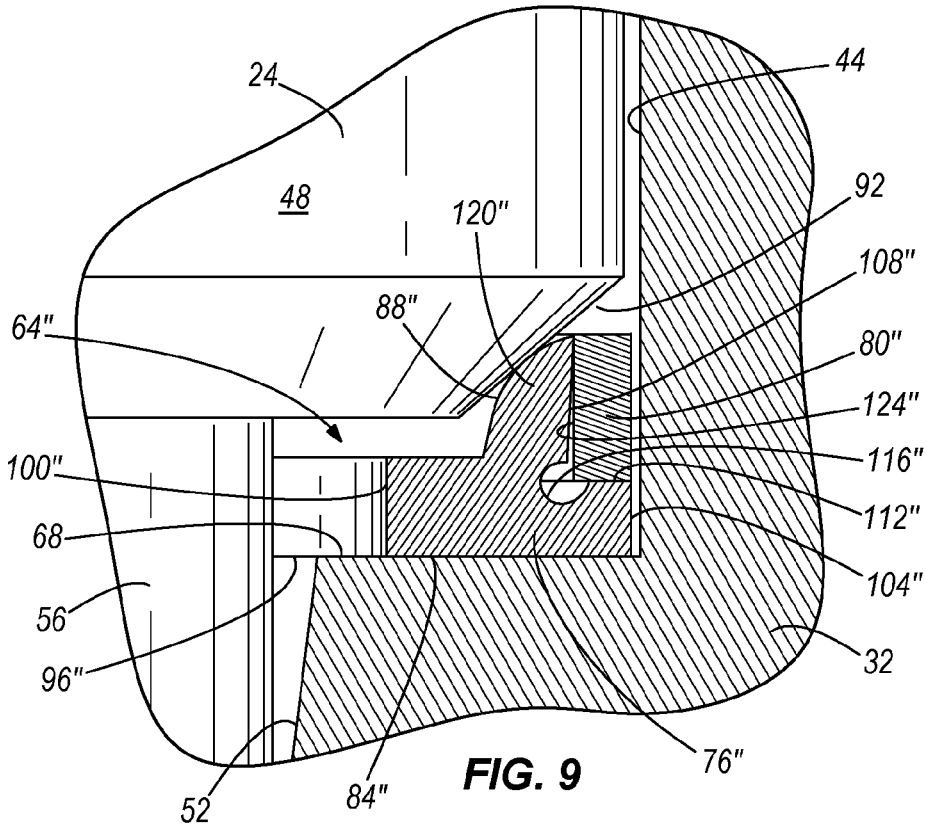
FIG. 9 is a view similar to FIG. 4 showing the tolerance ring of FIG. 8 in a second, radially-deflected position.

Furthermore, the fillet radius $r_1$, the fillet height FH, the clearance gap G, and the retainer ring thickness T can be optimized, perhaps using finite element analysis, to limit the radial deformation of the tolerance ring 76 so that the stress at the fillet 116 is within the elastic range, so that the tensile stress on the retainer ring 80 is well below the fatigue limit at maximum engine operating pressure, and so that axial energy transfer is minimized. For example, FIGS. 8 and 9 illustrate a modified tolerance ring assembly 64", in which like parts have been given like reference numerals indicated by double prime (''). FIG. 8 illustrates the first, un-deflected position, while FIG. 9 illustrates the second, radially-deflected position.

The modified tolerance ring assembly 64" includes a tolerance ring 76" in which the fillet 116" is formed at the intersection of the second outer surface 108" and the step surface 112", such that the fillet height FH has been reduced from that shown in FIGS. 3-5. This location of the fillet 116" changes the radial deformability of the tolerance ring 76" from that of the tolerance ring 76, with the fillet 116" formed partially in the second outer surface 108" and partially in the step surface 112". Also, the retainer ring 80" has a greater thickness than the ring 80 of FIGS. 3 and 4, thereby reducing the clearance gap G to further limit the amount of radial deflection the upper portion 120" can have. The increased thickness of the retainer ring 80" also increases the tensile strength of the retainer ring 80". Additionally, the diameters D1 and D2, the height of the retaining ring 80" and the distance from the step surface 112" to the lower surface 84" of the tolerance ring 76" can also be varied as desired. While the illustrated tolerance rings 76, 76" and the retainer rings 80, 80" are shown as made from steel, other metals and non-metal materials can also be substituted to optimize the characteristics of the tolerance ring assemblies 64, 64" as desired.

The tolerance ring assemblies 64 and 64" absorb the axial excitation energy from the injector by converting it to radial deformation in the respective tolerance ring 76, 76". The radial deformation is limited by the respective retainer rings 80, 80". With this design, noise transmission caused by vibration can be attenuated. In testing, significant reductions in noise (e.g., reductions up to about 5.5 decibels) were measured in the 8000 Hz to 16,000 Hz frequency range.

Figure 10:
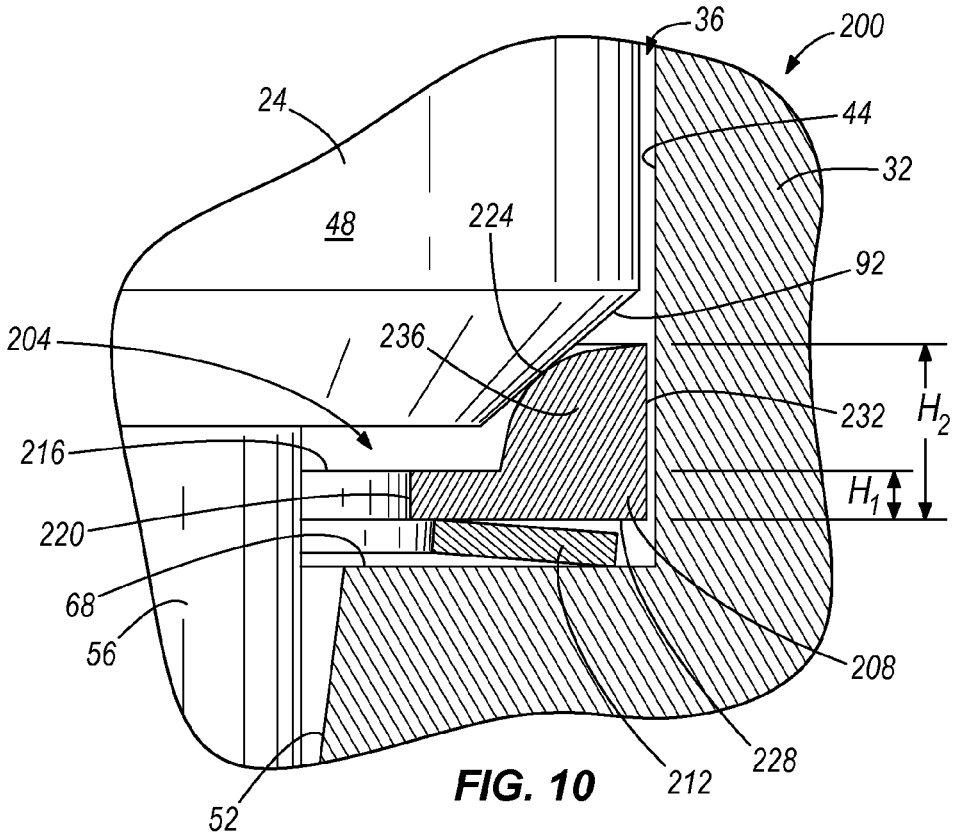
FIG. 10 is an enlarged partial section view illustrating a second injector mounting arrangement embodying the present invention with the tolerance ring in a first, un-deflected position.
Figure 11:
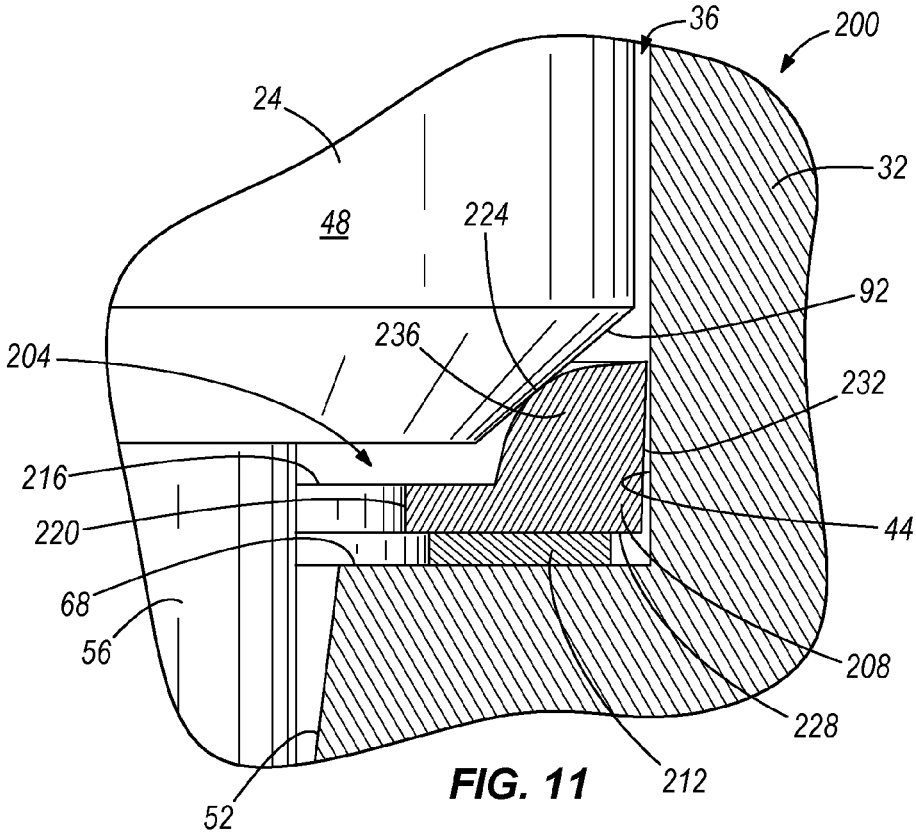
FIG. 11 is an enlarged partial section view illustrating the second injector mounting arrangement of FIG. 10 with the tolerance ring in a second, radially-deflected position.

FIGS. 10 and 11 illustrate a second injector mounting arrangement 200 for the injector 24 within the cylinder head 32. Like parts of the injector 24 and the cylinder head 32 have been given like reference numerals. This embodiment includes a tolerance ring assembly 204 different from the tolerance ring assemblies 64, 64" discussed above. The illustrated tolerance ring assembly 204 includes a tolerance ring 208 and a disk spring 212. The tolerance ring 208 includes an inner portion 216 defining an aperture 220 for receiving the tip 56 of the injector 24. The inner portion 216 has a height $H_1$ that is substantially less than a height $H_2$ of the entire tolerance ring 208 (see FIG. 10). In the illustrated embodiment, the height $H_1$ of the inner portion 216 is less than 50% of the maximum height $H_2$, can be between about 10% and about 30% of the height $H_2$, and further can be between about 15% and about 25% of the height $H_2$, thereby facilitating radial deformation of the tolerance ring 208, as will be discussed further below. It is noted that the height $H_1$ is substantially less than the height H of the tolerance rings 76 and 76".

The tolerance ring 208 further includes an arcuate alignment surface 224 adjacent the injector surface 92 for guidance and centering of the injector 24, a lower surface 228 adjacent the step surface 68 of the cylinder head 32, and a radial outer surface 232 extending between the lower surface 228 and the alignment surface 224. An upper portion 236 is the portion generally bounded by the alignment surface 224 and the outer surface 232 above the height $H_1$ of the inner portion. Axial forces (downwardly directed in FIGS. 10 and 11) act on the alignment surface 224, and due to the relatively small height $H_1$ of the inner portion, cause the resilient, radially-outwardly deflection of the tolerance ring upper portion 236, and more specifically, cause the outer surface 232 to deflect as shown in FIG. 11. Alternatively, the tolerance ring 208 can be further modified to include the stepped outer circumference, the fillet, and the retainer ring like used on the tolerance rings assemblies 64, 64" if desired. In other words, features of the tolerance ring assemblies 64, 64" and 204 can be combined and interchanged as desired to include selected features of each.

The disk spring 212 is positioned between the lower surface 228 of the tolerance ring 208 and the step surface 68 to provide a means for further absorbing the axial loading generated by the injector 24. The specific size and configuration of the disk spring 212 can vary as desired to change the amount of axial compression absorbed by the disk spring 212. FIG. 10 shows the disk spring 212 in its un-deflected state biasing the tolerance ring 208 axially away from the cylinder head 32 (upward in FIG. 10), while FIG. 11 illustrates the fully deflected or compressed position of the disk spring 212. In the illustrated embodiment, the allowable compression of the disk spring 212 is designed such that maximum travel of the injector tip during operation of the engine from idle to a maximum operating pressure (e.g., 200 bar) is less than 80 microns. The disk spring 212 also provides a fulcrum point where the disk spring 212 contacts the lower surface 228 of the tolerance ring 208 (see FIG. 10) to facilitate the radial deflection of the tolerance ring 208.

The tolerance ring assembly 204 thereby provides damping or isolation by absorbing the axial forces of the injector 24 both in compression, via the disk spring 212, and in the radial direction, via radial deformation of the upper portion 236 and the outer surface 232 of the tolerance ring 208. The combined absorption can be optimized by changing the characteristics of the disk spring 212 (e.g., the thickness, the fulcrum contact point with the lower surface 228, and the spring rate), and the geometry of the tolerance ring 208 (e.g., the ratio of the heights $H_1$ and $H_2$). Again, the parts should be designed for a given application to prevent plastic deformation or fatigue failure of the tolerance ring 208 and the disk spring 212. While the illustrated tolerance ring 208 and disk spring 212 are made of steel, other suitable metals and non-metals can be substituted as appropriate. Once again, features of the tolerance ring assemblies 64, 64" and 204 can be combined and interchanged as desired to include selected features of each.

Various features and advantages of the invention are set forth in the following claims.

What is claimed is:

1. A tolerance ring assembly for aligning an injector in a cylinder head and absorbing axial forces generated by the injector, the tolerance ring assembly comprising:

a tolerance ring having a lower surface configured to be positioned adjacent the cylinder head, an alignment surface configured to be coupled to the injector, an inner portion that defines an aperture configured to at least partially receive a tip of the injector, and a stepped outer circumference along a radially-outermost periphery of the tolerance ring, the stepped outer circumference defining a first outer surface with a first diameter and a second outer surface with a second diameter smaller than the first diameter; and a retainer ring positioned radially outwardly of the second outer surface and supported by a step surface defined between the first and second outer surfaces.

2. The tolerance ring assembly of claim 1, wherein the tolerance ring further includes a fillet formed at least partially in the second outer surface.

3. The tolerance ring assembly of claim 1, wherein the retainer ring has in inner diameter larger than the second diameter to provide clearance between the second surface and the retainer ring.

4. The tolerance ring assembly of claim 1, wherein the step surface defines a step width, and the retainer ring defines a retainer ring thickness that is less than the step width.

5. The tolerance ring assembly of claim 1, wherein the tolerance ring is radially resiliently deflectable to absorb an axial force applied by the injector, the radial deflection of the tolerance ring limited by the retainer ring.

6. The tolerance ring assembly of claim 5, wherein the second surface of the tolerance ring is movable radially outwardly during radial deflection of the tolerance ring until the second surface engages an inner surface of the retainer ring, thereby limiting the radial deflection of the tolerance ring.

7. The tolerance ring assembly of claim 1, wherein the inner portion has a substantially constant height.

8. The tolerance ring assembly of claim 1, wherein the inner portion includes slots therein to reduce a stiffness of the tolerance ring.

9. An injector mounting assembly for aligning an injector in a cylinder head and absorbing axial forces generated by the injector, the injector mounting assembly comprising:

a fuel injector;

a tolerance ring having a lower surface positioned adjacent the cylinder head, an alignment surface coupled to the injector, an inner portion that defines an aperture configured to at least partially receive a tip of the injector, and a stepped outer circumference along a radially-outermost periphery of the tolerance ring, the stepped outer circumference defining a first outer surface with a first diameter and a second outer surface with a second diameter smaller than the first diameter; and a retainer ring positioned radially outwardly of the second outer surface and supported by a step surface defined between the first and second outer surfaces;

wherein the tolerance ring is radially resiliently deflectable to absorb an axial force applied by the injector, the radial deflection of the tolerance ring limited by the retainer ring.

10. The injector mounting assembly of claim 9, wherein the tolerance ring further includes a fillet formed at least partially in the second outer surface, the fillet facilitating resilient radial deflection of the tolerance ring.

11. The injector mounting assembly of claim 9, wherein the retainer ring has an inner diameter larger than the second diameter to provide clearance between the second surface and the retainer ring when the tolerance ring is in an un-deflected state.

12. The injector mounting assembly of claim 9, wherein the step surface defines a step width, and the retainer ring defines a retainer ring thickness that is less than the step width.

13. The injector mounting assembly of claim 9, wherein the second surface of the tolerance ring is movable radially outwardly during radial deflection of the tolerance ring until the second surface engages an inner surface of the retainer ring, thereby limiting the radial deflection of the tolerance ring.

* * * * *